US007634100B2

(12) United States Patent
Monitto et al.

(10) Patent No.: US 7,634,100 B2
(45) Date of Patent: Dec. 15, 2009

(54) RIGGING SYSTEM FOR LOUDSPEAKERS

(75) Inventors: John Monitto, San Rafael, CA (US); John McGhee, Parkdale, OR (US); Dean Marshall, San Rafael, CA (US)

(73) Assignee: Meyer Sound Laboratories, Incorporated, Berkeley, CA (US)

( * ) Notice: Subject to any disclaimer, the term of this patent is extended or adjusted under 35 U.S.C. 154(b) by 846 days.

(21) Appl. No.: 11/035,676

(22) Filed: Jan. 13, 2005

(65) Prior Publication Data

US 2005/0232455 A1 Oct. 20, 2005

Related U.S. Application Data

(60) Provisional application No. 60/536,429, filed on Jan. 13, 2004, provisional application No. 60/548,364, filed on Feb. 27, 2004.

(51) Int. Cl.
*H04R 25/00* (2006.01)

(52) U.S. Cl. ..... 381/386; 381/87; 381/335

(58) Field of Classification Search ..... 381/87, 381/300, 304, 305, 332, 334, 335, 336, 182, 381/185, 386; 181/144, 145, 199, 150; 248/284.1, 248/323, 324

See application file for complete search history.

(56) References Cited

U.S. PATENT DOCUMENTS 4,101,109 A 7/1978 Edwards
4,660,728 A 4/1987 Martin
5,000,286 A 3/1991 Crawford et al.
5,266,751 A 11/1993 Taguchi
5,620,272 A 4/1997 Sheng
5,758,852 A 6/1998 Martin
5,816,545 A 10/1998 Malizin
5,819,959 A 10/1998 Martin (Continued)

*Primary Examiner*—Huyen D Le
(74) *Attorney, Agent, or Firm*—Donald L. Beeson; Beeson Skinner Beverly

(57) ABSTRACT

A side frame for a loudspeaker rigging system has a frame structure mountable to the side of a loudspeaker, and links associated with the frame structure for linking together the corners of the frame structures of vertically adjacent side frames. The links associated with each side frame structure include a pivot link and splay adjustment link, each of which has a top extended end and a base end with a seating edge. Guide channels, which are located in the top corner regions of the frame structure to receive the base ends of a pivot link and splay adjustment link associated with a vertically adjacent side frame, have seating surfaces that conform to the seating edges at the base ends of the pivot and splay adjustment link. When base ends of these links seat in the guide channels, pin holes in the base end of the links self-align with pin holes in the corners of the frame structure for easy insertion locking pins. The extended end of the splay adjustment link further includes at least two, and preferably an array of pin holes which can selectively be matched with one pin hole within a row of pin holes in a bottom corner region of the side frame to permit adjustments of the splay angle over a range of angles. Suitably, two rows of pin holes are provided in the top extended end of the splay adjustment link to permit multiple and incrementally small splay angle adjustments. In the preferred embodiment, the frame structure is comprised of an assembly of parts comprised of a center core structure sandwiched between two side plates.

30 Claims, 8 Drawing Sheets

U.S. PATENT DOCUMENTS

| | | | | |
|---|---|---|---|---|
| 5,996,728 | A | 12/1999 | Stark | |
| 6,009,182 | A | 12/1999 | Gunness | |
| 6,536,554 | B2 | 3/2003 | Andrews et al. | |
| 6,640,924 | B2 | 11/2003 | Messner | |
| 6,652,046 | B2 | 11/2003 | Christner | |
| 7,201,251 | B1 * | 4/2007 | Baird | 181/145 |
| 7,298,860 | B2 * | 11/2007 | Engebretson et al. | 381/386 |
| 7,328,769 | B1 * | 2/2008 | Adamson | 181/199 |

* cited by examiner

RIGGING SYSTEM FOR LOUDSPEAKERS

CROSS-REFERENCE TO RELATED APPLICATIONS

This application claims the benefit of U.S. Provisional Application No. 60/536,429 filed Jan. 13, 2004, and U.S. Provisional Application No. 60/548,364 filed Feb. 27, 2004.

BACKGROUND

The present invention relates to loudspeaker rigging systems and more particularly to rigging hardware for suspending a stacked array of loudspeakers of a sound reinforcement system at a predetermined location relative to an audience. The present invention has particular application in rigging a stacked array of loudspeakers wherein a vertical display between loudspeakers is desired to achieve a desired coverage and acoustic performance.

Sound systems for large venues typically involve the suspension or "flying" of stacks of loudspeakers in vertical arrays to achieve a desired acoustic output and coverage for a large audience. Such vertical stacks of loudspeakers are typically suspended and held together by rigging systems which can be attached to rigging hoists which position the stack at a desired elevation and location, typically above or in the vicinity of a performance stage. A flown stack of loudspeakers can include many speaker boxes and the rigging system for flying the stack must be strong enough to support the enormous weight of the large stack. Such rigging systems generally involve the use of metal frame elements secured to the speaker boxes that can be used to link the speakers together in a stacked arrangement and to lift the stack to an overhead flying position.

Typically, the individual speaker boxes of a vertical stack of loudspeakers held by a rigging system will have to be adjusted to meet the requirements of a particular application. Setting the proper angle between speakers, or "splay angle," can be critical to achieving desired acoustic performance and minimizing interference between the acoustic output between speakers in the stack. Splay angles are adjusted by adjusting the linkages between the rigging frames of the stacked speakers to create a desired angle. One such adjustment method is disclosed in U.S. Pat. No. 6,640,924 issued Nov. 4, 2003 to Ian Messner (the "Messner patent"). The Messner patent discloses a rigging system wherein the splay angle is adjusted by a cam plate that pivotally extends down from the bottom front end of the side frame of one loudspeaker to engage the top front end of the side frame of the loudspeaker directly below. To set the splay angle, the cam plate must be manipulated into a cam plate receiving channel in the top of the underneath side frame and pinned when the desired cam hole is aligned with the pin hole in the under frame. This process turns out to be relatively difficult and leads to misses in the hole alignment while assembling the array. The number of pinning locations is also relatively limited.

There is a need for a rigging system for loudspeakers having splay angle adjustment capabilities that is relatively easy to assemble, and that provides a greater range and smaller increments of adjustment in the settings for the loudspeaker splay angles.

SUMMARY OF THE INVENTION

Briefly, the present invention involves a new side frame for a loudspeaker rigging system comprised of a frame structure having two top corner regions and two bottom corner regions.

A pivot link and a splay adjustment link are associated with the side frame for linking the side frames with side frames of vertically adjacent loudspeakers in a stack of loudspeakers. Each of these links has a base end and a top extended end and locking pin holes at each end for pinning the links to the side frames. At least one cradling guide channel is provided in one of the top or bottom corner regions of the frame structure for receiving the base end of one of the links of an adjacent side frame. The guide channel has side walls and locking pin holes through the side walls which are positioned to align with the pin hole of the link of an adjacent frame structure that is inserted into and seated within the guide channel. Preferably, there is a correspondence in the shape of the guide channel and the base end of the link seated within the channel such that the locking pin holes in the guide channel and the base end of the link will readily align when the base of the link is dropped into the guide channel. Preferably, two cradling guide channels are provided, preferably in the two top corner regions of the frame, for receiving correspondingly-shaped base ends of both the pivot link and the adjustment link of an adjacent rigging side frame, such that, when the end of both links are dropped into the guide channels, the locking pin holes in both links and the guide channels self-align.

In a further aspect of the invention, two link stowing channels are provided in the corner regions of the frame structure vertically opposite the cradling guide channels. The link stowing channels are formed to receive a link in a stowed position within the frame structure, and each stowing channel has side walls provided with at least one pin hole for pinning the links in the stowing channels.

In another aspect of the invention, the extended end of the splay adjustment link is provided with at least two selectable pin holes at different incremental distances from the locking pin hole at the base of the link. At least one pin hole is provided in the splay adjustment link stow channel of the frame structure for receiving at least two pin holes in the extended end of the adjustment link such that, with a vertical adjustment of the splay adjustment link, a selected one of the two pin holes in the adjustment link can be pinned to the corresponding pin hole in the adjustment link stow channel to adjust or set the vertical splay angle of the side frame relative to the rigging side frame of a vertically adjacent loudspeaker. It is contemplated that an array of pin holes will be provided in the extended end of the splay adjustment link which match up with a plurality of pin holes in the adjustment link stow channel, whereby pinning one of the adjustment pin holes to one of the pin holes of the stow channel will permit the side frame to be adjusted between a multiple of selectable splay angles.

In still a further aspect of the invention, the side frame is a frame assembly which includes a center core structure which provides or forms cradling guide channel cutout regions and stow channel cutout regions. Side plates affixed to either side of the center core structure extend over these cutout regions and provide the side walls for the guide channels. Suitably, the frame assembly comprises at least two center core sections for achieving the desired structural configuration. The panel assembly is relatively easy to fabricate and assemble as compared to the steel tube construction of conventional rigging assemblies.

DESCRIPTION OF THE ILLUSTRATED EMBODIMENT

Figure 1:
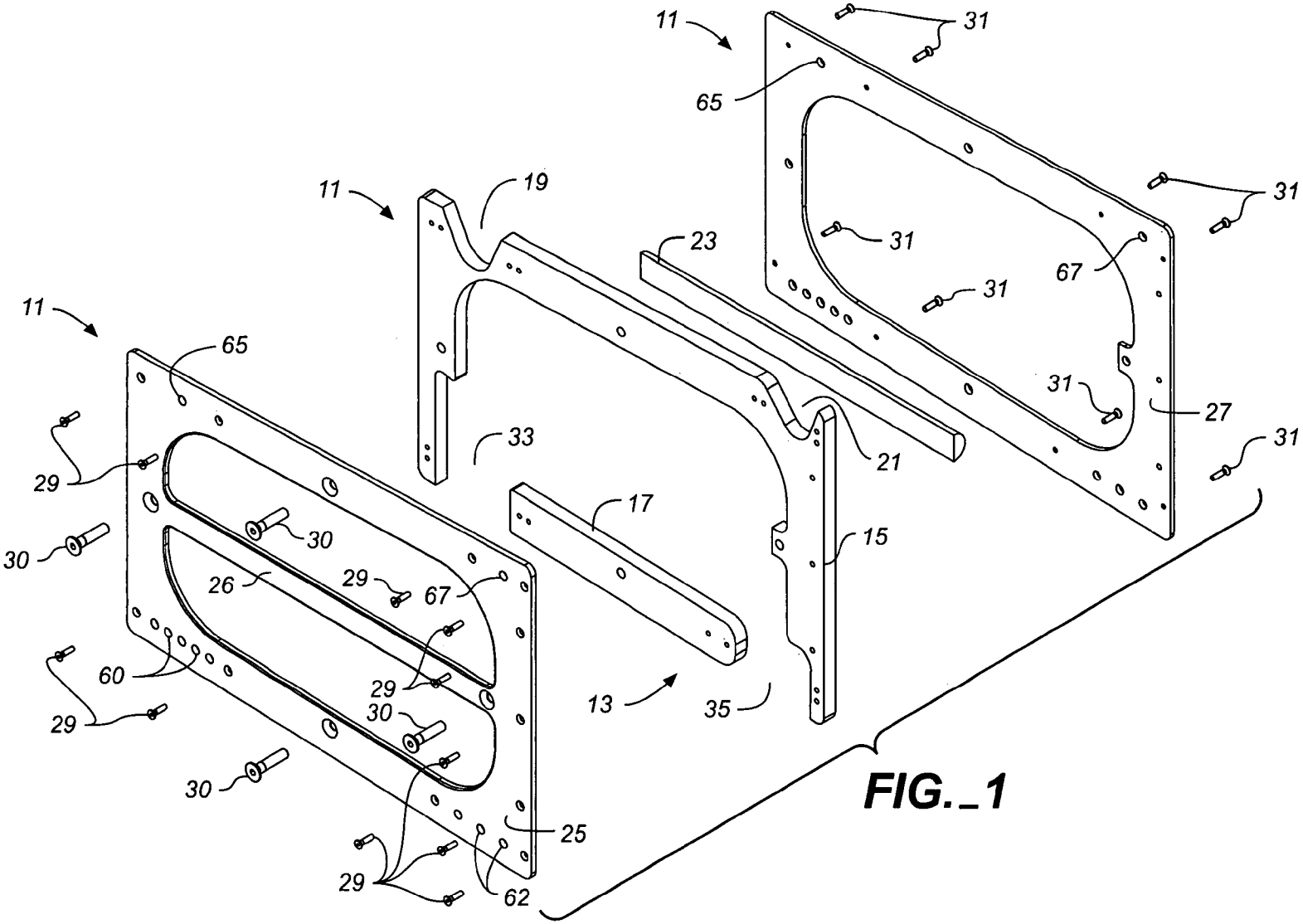
FIG. 1 is an exploded view of a frame assembly for the rectilinear frame structure of a speaker rigging side frame in accordance with the invention.

The preferred frame structure of the rigging side frame of the invention is disclosed in FIG. 1. The frame structure is comprised of a frame assembly denoted by the numeral 11 having a center core structure 13 which includes upper perimeter core section 15 and a lower cross-bar center core section 17. The upper perimeter center core section includes two cutouts 19, 21, which provide seating surfaces for link guide channels of the assembled frame as hereinafter described. The center core structure of the assembly is sandwiched between front and back side plates 25, 27 that are secured to the center core sections by suitable attachment screws 29, 30, 31. When assembled, the open regions 33, 35 between the bottom ends of upper perimeter core section 15 and the lower cross-bar 17, form additional guide channels for stowing the links of the side frame as also hereinafter described.

With further reference to FIG. 1, the front side plate 25 of the frame assembly is seen to include a cross-bar 26, which serves as a handle or stepping rail usually found on conventional rigging frames. Backing bar 23 is provided to give this handle additional structural support. The backing bar can be attached to the back of the handle by suitable screw attachments (not shown).

It will be understood that the center core structure 13 of frame assembly 11 could be divided into more sections than shown. For example, the upper perimeter center core section 15 could be split into two or more sections for ease of fabrication and assembly. Also, a center core structure fabricated as a single piece is considered within the scope of the invention. It will also be understood that certain aspects of the invention described below could be achieved with a unitary frame structure that is not an assembly of parts.

Figure 2:
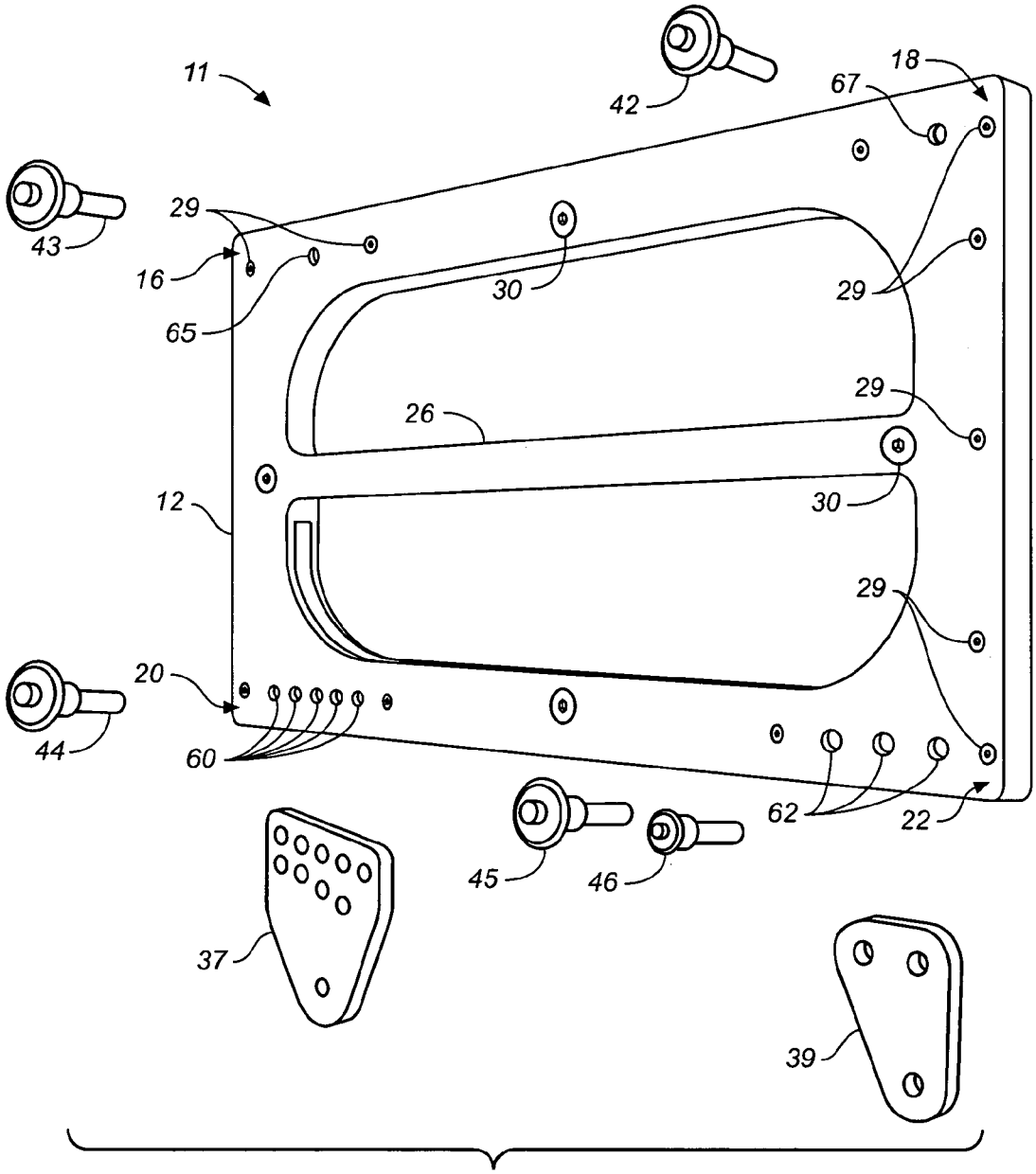
FIG. 2 is an perspective view of the rigging side frame of the invention showing the assembled frame structure, a pivot link and splay angle adjustment link associated with the side frame, and quick release pins for pinning the links to the side frame structure.

FIG. 2 shows the frame assembly 11 in FIG. 1 assembled into a frame structure 12, along with an associated splay adjustment link 37 and pivot link 39. FIG. 2 additionally shows top locking pins 42, 43, and bottom locking pins 44, 45, 46, used for pinning the splay adjustment link and pivot link in operative and stowed positions. It is seen that the assembled frame structure has a generally rectangular shape with top corner regions 16, 18, and bottom corner regions 20, 22, which receive the splay adjustment and pivot links as described below, and which are linked to the corner regions of side frames of vertically adjacent loudspeakers. The locking pins are used to pin these links in place as later described by means of the pin holes 60, 62 located in the bottom corner regions of the frame, and pin holes 65, 67 located in the top corner regions of the frame. Suitably these pins will be commercially available quick release pins.

FIGS. 3-6 show how the splay adjustment link 37 and pivot link 39 are deployed and pinned in the side frame structure 12 when in use and when the links are stowed away. The front plate 25 (see FIG. 1) is removed from the structure in FIG. 3 for illustrative purposes.

Figure 3:
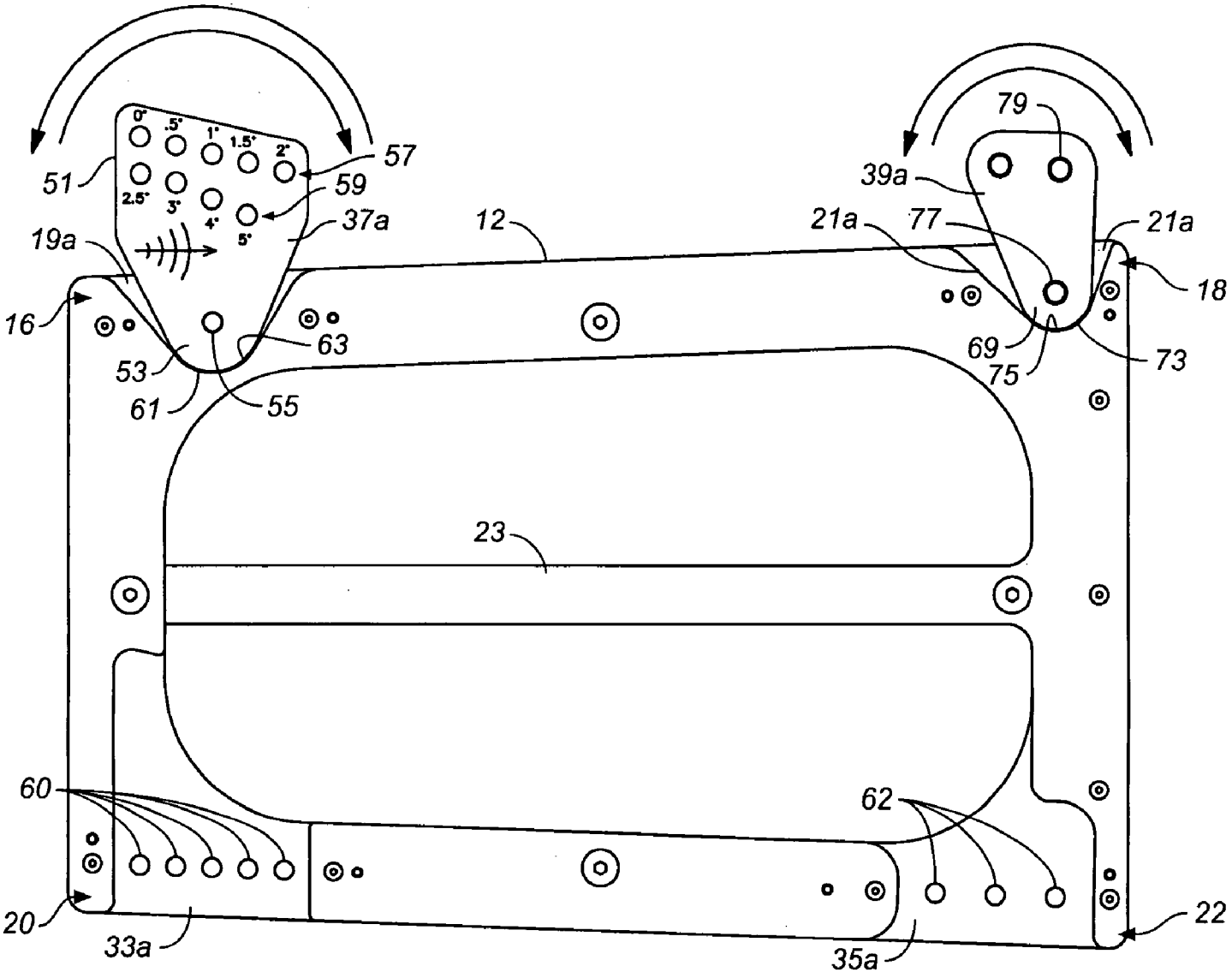
FIG. 3 is a front elevational view of the frame assembly shown in FIG. 1 with the front side plate removed to reveal the guide channels and stow channels of the side frame structure and how the splay adjustment link and pivot link cradle within their respective channels to align the pin holes in the links and the side frame assembly.
Figure 4:
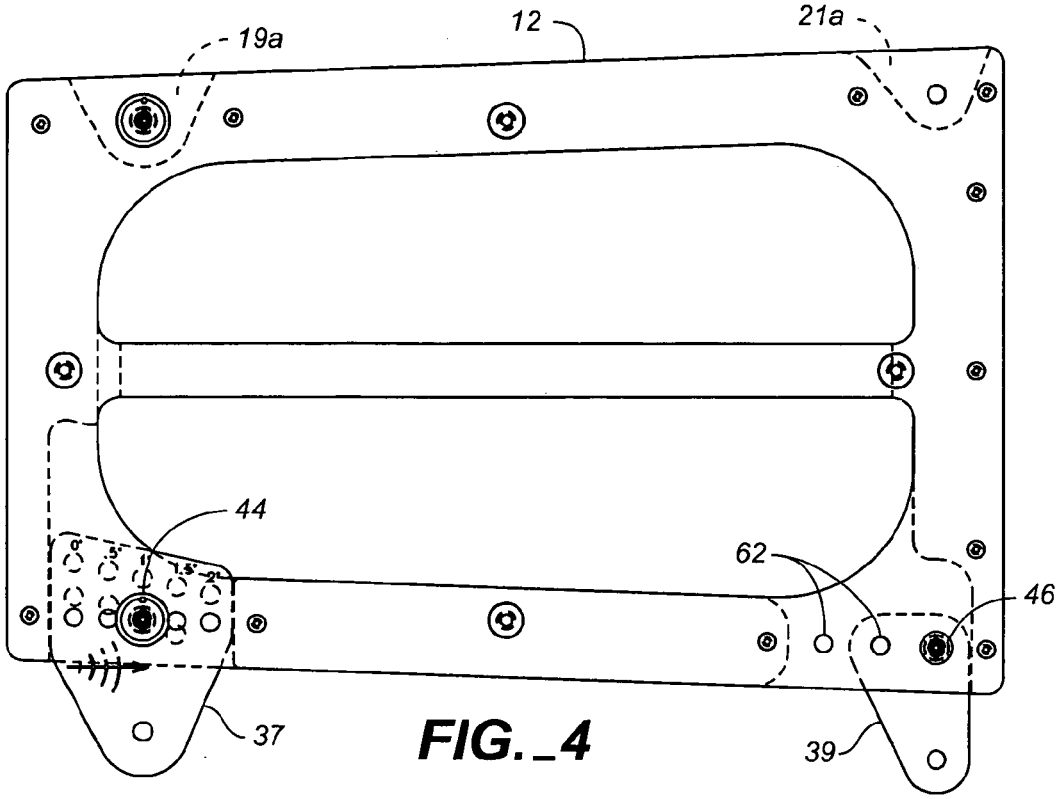
FIG. 4 is a front elevational view of a side frame assembly in accordance with the invention showing the adjustment link and pivot link pinned in an operative position within the stow channels of the side frame assembly.
Figure 5:
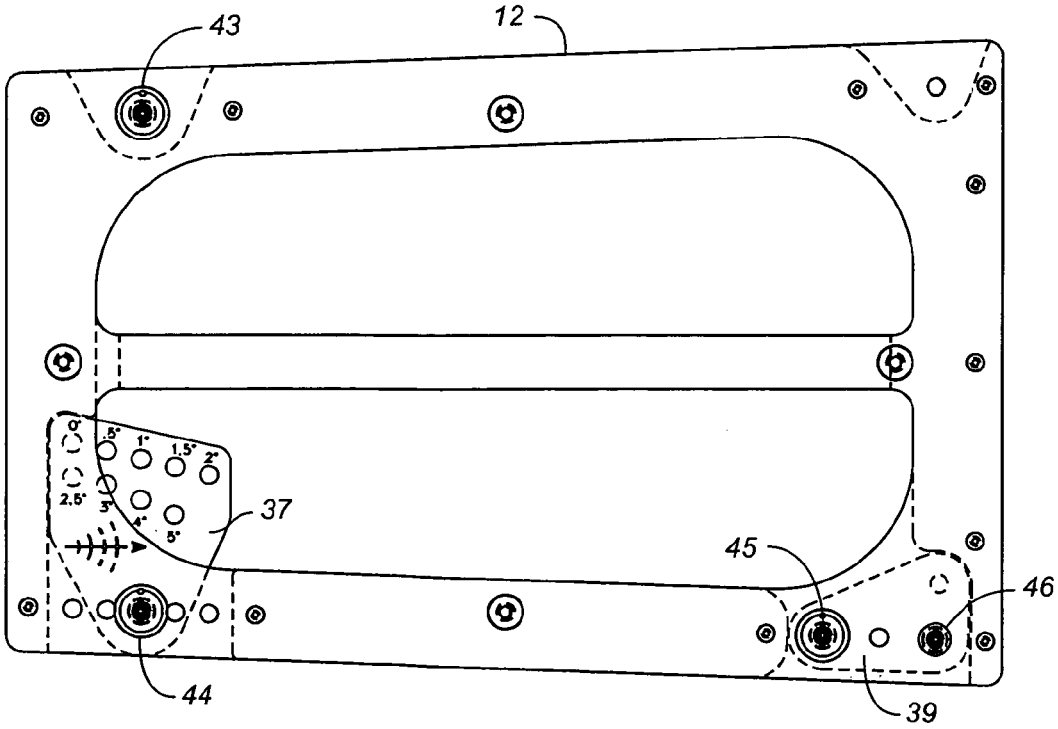
FIG. 5 is a front elevational view of the side frame assembly shown in FIG. 4 with the splay adjustment link and pivot link shown in their stowed position in the stow channels of the side frame assembly.
Figure 6:
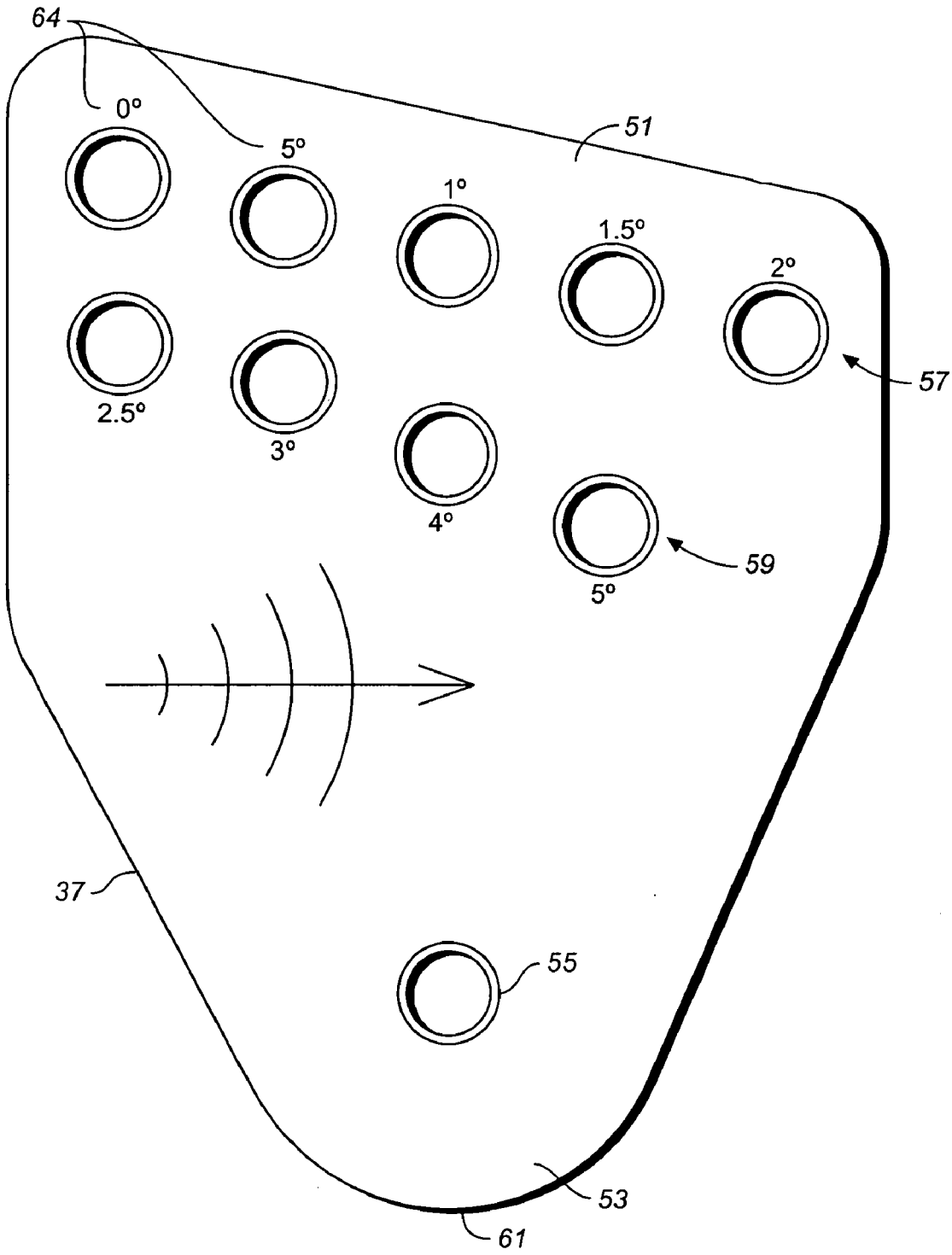
FIG. 6 is an enlarged front elevational view of the splay adjustment link shown in the foregoing figures.

First, it will be appreciated that each rigging side frame of the invention, such as shown in FIGS. 3-5, will nominally have one associated splay adjustment link 37 and one associated pivot link 39, which are stowed in the frame as shown in FIG. 5, but will receive an adjustment link 37*a* and pivot link 39*a* associated with a side frame of a vertically adjacent loudspeaker within a stack of loudspeakers, such as shown in FIG. 3. As best illustrated in FIGS. 3 and 6, the splay adjustment link associated with each side frame structure is seen to include a top extended end 51, a base end 53, a base end locking pin hole 55, and an array of two rows of adjustment locking pin holes, namely top row 57 and bottom row 59. The base end of the adjustment link has a rounded bottom seating edge 61 that corresponds to the rounded bottom seating surface 63 of adjustment link guide channel 19*a* in the top corner regions 16, 18 of the frame structure. The guide channel 19*a* is formed between side plates 25, 27 by the cutout 19 in the frame assembly's center core section 15. Pin holes 65 in side plates 25, 27 shown in FIG. 1 are located centrally of the cutout 19 such that when the base end of splay adjustment link 37*a* associated with a vertically adjacent side frame seats within and is cradled by the curved bottom of the channel formed by the cutout as shown in FIG. 3, the pin hole 55 of the link and the pin holes 65 of the frame side plates align. This self-alignment facilitates the pinning of the splay adjustment link to the top corner region of the side frame when assembling the loudspeaker rigging.

With further reference to FIG. 3, the pivot link 39*a* associated with the vertically adjacent rigging side frame is shown. It similarly has a base end 69 and a top extended end 71. The rounded bottom seating edge 73 of this link's base end 69 conforms to the rounded seating surface 75 of cutout 21, such that, when the base end of the pivot link seats within the guide channel 21*a* formed by cutout 21 and side plates 25, 27, the locking pin hole 77 in the base of the pivot link aligns with the locking pin holes 67 in the side plates of the frame assembly. Thus, the pivot link is also self-aligning when it is dropped into the guide channel of the side frame assembly.

A splay adjustment link stow channel 33*a* and a pivot link stow channel 35*a* are provided in the bottom corner regions 20, 22 of frame structure 12 vertically opposite the frame structure's top guide channels 19*a*, 21*a*. As above-mentioned, these stow channels are formed by the open regions 33, 35 between the frame assembly's core sections 15,17, which are bounded by the assembly's side plates 25, 27. Pin holes 60, 62 allow the splay adjustment link and pivot link to be operatively pinned in a stowed or deployed position; pin holes 60 further allow for fine adjustments of splay angles between adjacent rigging frames. How the splay adjustment link and pivot link are operatively pinned and stowed within these channels is illustrated in FIGS. 4 and 5.

To interconnect the rigging side frames of two adjacent loudspeakers in a stack of loudspeakers, the pivot link 39 is first dropped from its stowed position shown in FIG. 5 by removing locking pin 45 and pivoting the link out of its stowed position about locking pin 46, which remains in place. The base end of the link is dropped down into a pivot link guide channel 21*a* of an adjacent frame until it seats in the bottom of the guide channel 21*a*, whereupon it is pinned to the adjacent frame by using the stowed locking pin 45. Locking pin 44 is then removed from the stowed splay adjustment link adjustment 37 to allow the adjustment link to vertically drop down out of its stowed position. A splay angle is first selected by matching a selected one of the splay adjustment pin holes of the rows 57, 59 of pin holes on the extended end 51 of the adjustment link 37 with a corresponding one of the holes in the row of adjustment pin holes 60 in the frame structure's bottom corner region 20. The selected adjustment pin hole will determine the degree of drop of the adjustment link and hence the splay angle. As best illustrated in FIG. 6, angle indications 64 are suitably provided on the splay adjustment link next to each splay adjustment pin hole to assist the user in selecting a desired angle. For example, adjustment pin holes in the two rows of pin holes 57, 59, can be located on the extended end of the splay adjustment link so as to permit splay adjustments of zero degrees to five degrees in 0.5 degree increments. This requires nine pin holes as shown, at set locations on the link that produce the desired angle. It will be appreciated that the splay adjustment link can be provided with more or fewer pin holes for different possible splay adjustments.

Once a selected one of the splay adjustment pin holes on the splay adjustment link is matched with the corresponding pin hole in the frame's row of pin holes 60, the adjustment link is pinned in place by the locking pin 44 to lock the link into a position as shown in FIG. 4. In this position, the third from the left pin hole in the second row of pin holes 59 of the splay adjustment link matches up with the center one of the row of pin holes 60 in the frame's bottom left corner region 20. Using the adjustment link 37 shown in FIG. 6, this pinning of the link produces a splay angle of four degrees.

In the locked position shown in FIG. 4, the base end 53 of the splay adjustment link 37 is lowered into the adjustment link guide channel 19*a* on top of the side frame 12 of the underneath adjacent loudspeaker until the bottom edge 61 of the link seats in the guide channel so as to align pin hole 55 in the base end of the link with pin holes 65 in the frame's side plates 25, 27. With the pin holes aligned, the splay adjustment link is then pinned into place on the vertically adjacent frame using a locking pin 43.

Preferably, the adjustment and pivot links 37, 39 are fabricated of steel along with the outer side plates 25, 27 of the frame assembly, while center core structure 13 of the frame assembly is fabricated of a softer material such as aluminum or a plastic material such as Delrin or polyethene. When rigging loudspeakers, the softer core material will yield to the steel links, which carry the weight of the loudspeakers. The softer core material will also help direct the nose of the link into the guide channels for alignment with the pin holes.

Figure 7:
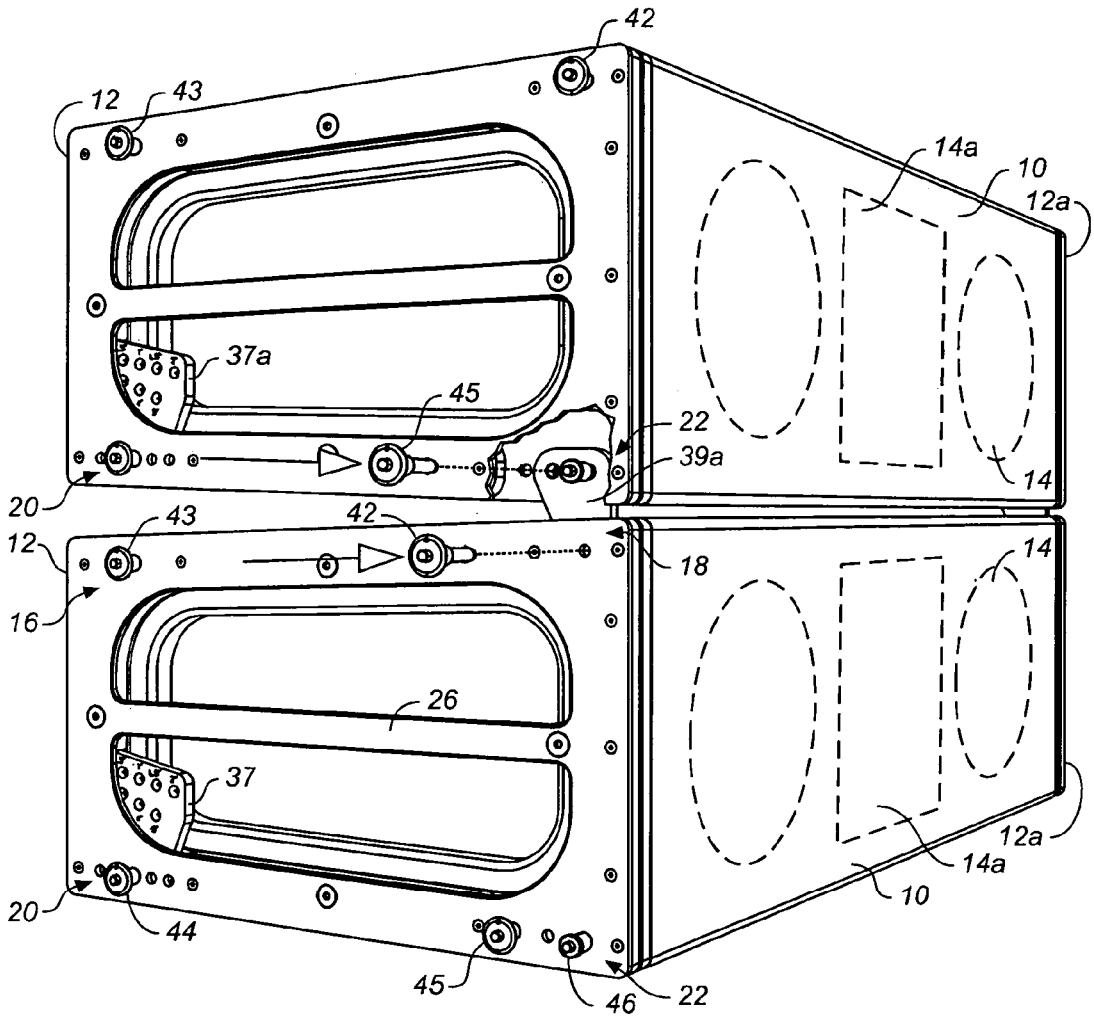
FIG. 7 is a perspective view of a stack of loudspeakers with rigging side frames in accordance with the invention partially cut-away to show a deployed pivot link and showing a stowed splay adjustment link.
Figure 8:
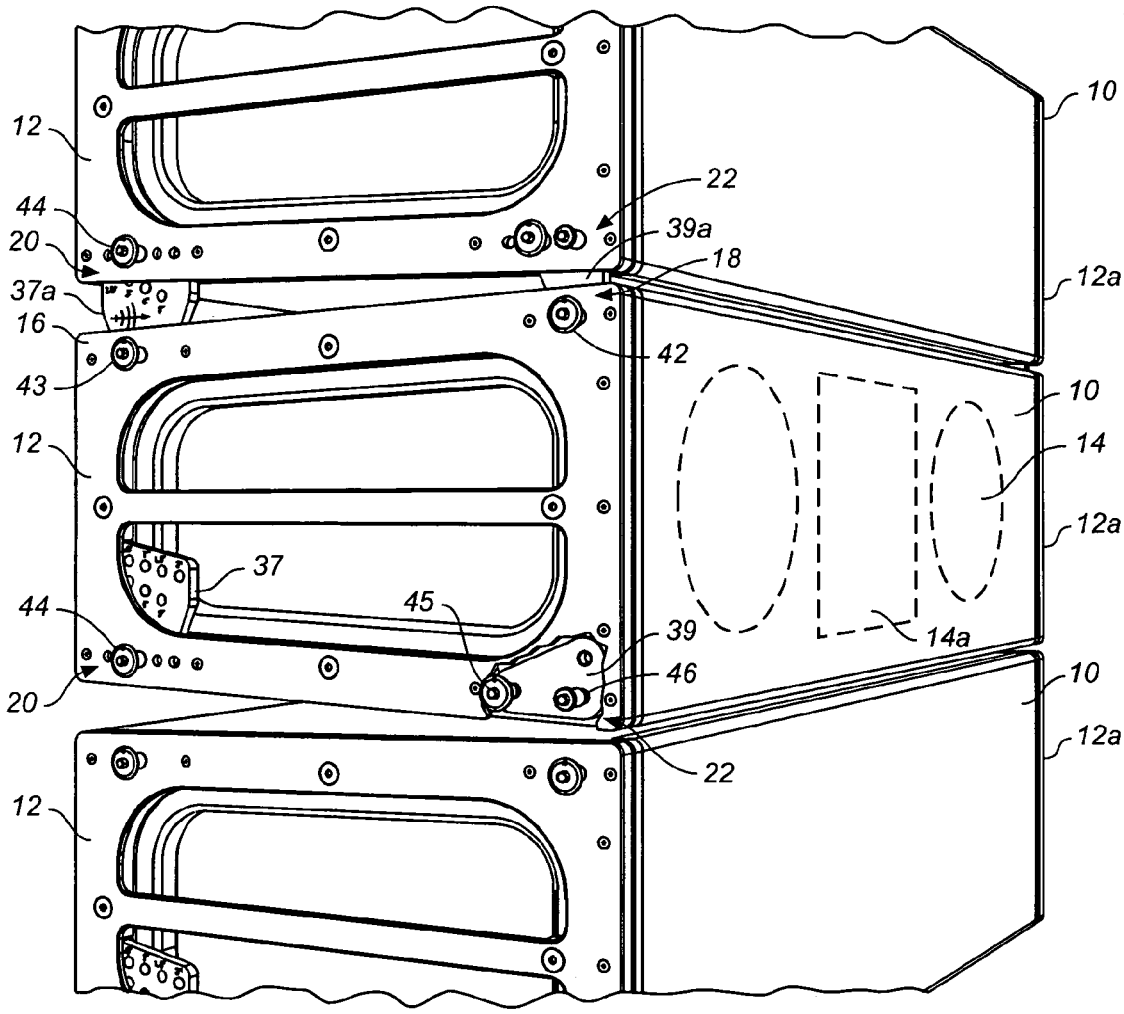
FIG. 8 is another perspective view of a stack of loudspeakers with rigging side frames in accordance with the invention showing a deployed pivot link and splay adjustment link between the top two loudspeakers and partially cut-away at the bottom of one loudspeaker to show a stowed pivot link.
Figure 9:
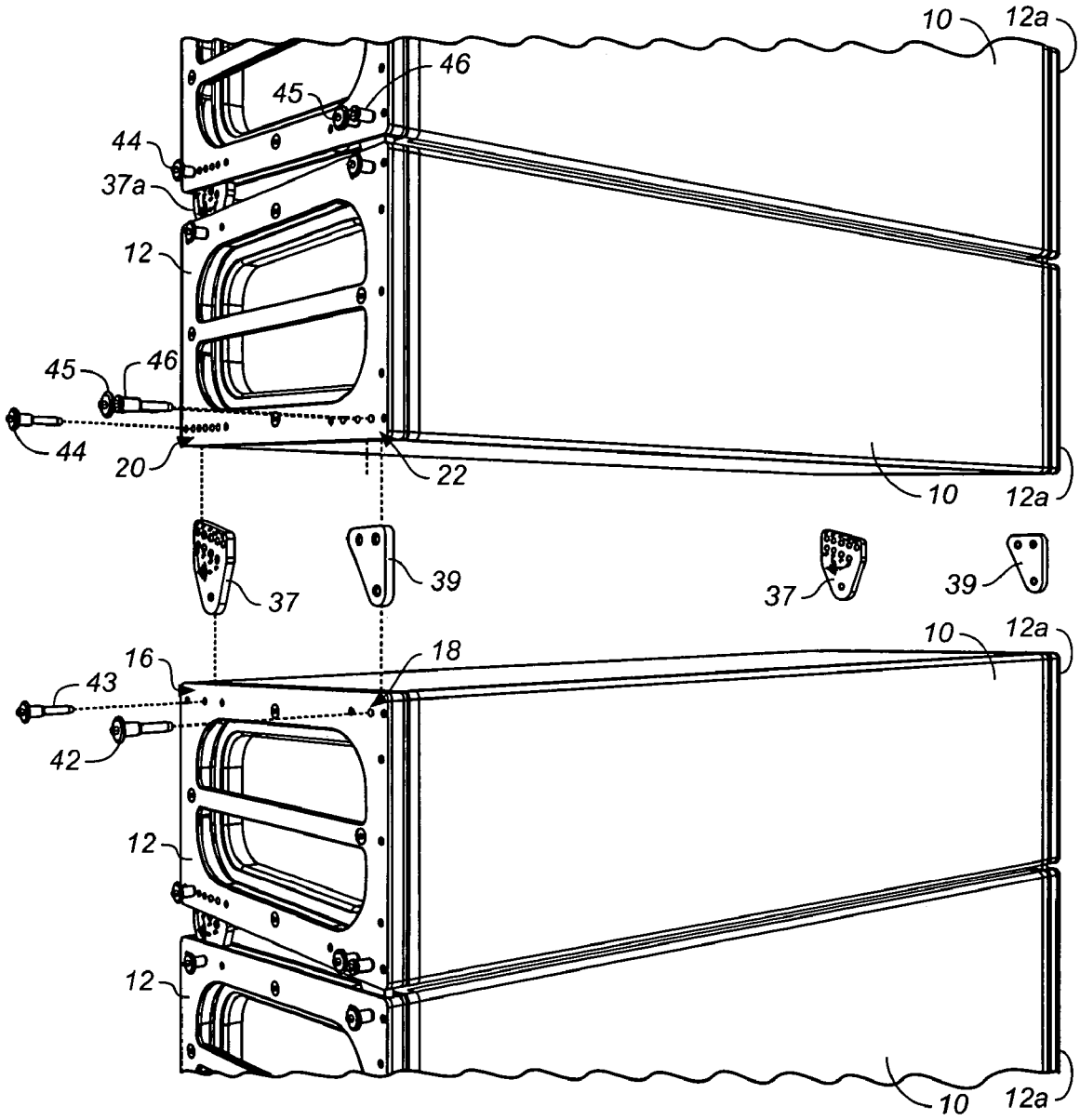
FIG. 9 is a side perspective view of a stack of loudspeakers with rigging side frames in accordance with the invention with the links and associated release pins exploded from the side frames of two vertically adjacent loudspeakers.

The use of the rigging side frames of the invention is further illustrated in FIGS. 7-9, wherein left and right rigging frames 12, 12*a* are shown mounted to the sides of vertically stacked loudspeakers 10 in a conventional manner, such as shown in U.S. Pat. No. 6,640,924. These figures show the front of the loudspeakers, which contain the acoustic drivers 14 and/or horns 14*a* as represented in dashed lines. The front pivot links 39, 39*a* are seen to link the front corners 18, 22 of the left and right rigging frames mounted to the stacked loudspeakers 10, while the splay adjustment links 37, 37*a* link the frame's rear corners 16, 20. Splay angles between the stacked loudspeakers are achieved at the rear corners of the frames by the splay angle adjustment link as shown, with the capability of making a relatively large number of incremental splay angle adjustments as above described due to the large number of matched pin hole combinations provided by the two rows of multiple pin holes in the adjustment link. The five locking pins 42, 43, 44, 45, and 46 associated with each rigging frame are all the locking pins required both to deploy the splay adjustment and pivot links when rigging the loudspeakers and to stow the links when not in use.

It is noted that while the most practical implementation of the invention involves providing the guide channels 19*a* and 21*a* at the top corner regions of frame structure 12 and the stow channels 33*a* and 35*a* at the bottom corner regions, reversing the channels so that the guide channels are on top and the stow channels are on the bottom of the frame is considered to be within the scope of the invention.

While the present invention is described in considerable detail in the foregoing specification, it is not intended that the invention be limited to such detail, except as necessitated by the following claims.

What we claim is:

1. A rigging side frame for a loudspeaker which can be interconnected with rigging side frames of other loudspeakers for interconnecting loudspeakers in a stacked relation, wherein loudspeakers in the stack of loudspeakers have sides to which left and right rigging frames can be mounted, said rigging side frame comprising a frame structure mountable to the side of a loudspeaker, said frame structure having two top corner regions and two bottom corner regions, at least one pivot link and splay adjustment link associated with said frame structure for linking the side frame of one loudspeaker to the side frame of a vertically adjacent loudspeaker, said pivot link and splay adjustment link each having a base end and a top extended end, the base end of each of said pivot link and splay adjustment link having at least one base end locking pin hole for pinning the base ends of said links to one of the corner regions of a vertically adjacent frame structure, and at least one of the top or bottom corner regions of said frame structure including a guide channel formed to receive and cradle the base end of one of the pivot link or splay adjustment link of a vertically adjacent side frame, said guide channel having a seating surface and locking pin holes that are spaced relative to said seating surface so that the locking pin hole in the base end of the pivot link or splay adjustment link self-aligns with the locking pin hole of said guide channel when the base end of said link is inserted in said guide channel against the seating surface thereof.

2. The rigging side frame of claim 1 wherein the seating surface of said guide channel and the base end of said pivot link or splay adjustment link received by said guide channel have complimentary rounded shapes.

3. The rigging side frame of claim 1 wherein said at least one guide channel is located in one of the top corner regions of said frame structure.

4. The rigging side frame of claim 3 wherein each of the top corner regions of said frame structure includes a guide channel with a seating surface and associated locking pin holes, one of said guide channels being formed to receive and cradle the base end of the pivot link of a vertically adjacent side frame so that the locking pin hole therein self-aligns with the locking pin hole of said one guide channel when the base end of said pivot link is inserted in said guide channel against the seating surface thereof, and the other of said guide channels being formed to receive and cradle the base end of the splay adjustment link of a vertically adjacent side frame so that the locking pin hole therein self-aligns with the locking pin hole of said other guide channel when the base end of said splay adjustment link is inserted in said other guide channel against the seating surface thereof.

5. The rigging side frame of claim 1 wherein said frame structure is an assembly comprised of outer side plates and a center core structure sandwiched between said side plates, said core structure having at least one cutout forming the guide channel in said frame structure and the seating surface of said guide channel.

6. The rigging side frame of claim 5 wherein said center core structure is fabricated of a softer material than said side plates.

7. The rigging side frame of claim 6 wherein said side plates are fabricated of steel and said center core structure is fabricated of aluminum.

8. The rigging side frame of claim 6 wherein said side plates are fabricated of steel and said center core structure is fabricated of plastic.

9. A rigging side frame for a loudspeaker which can be interconnected with rigging side frames of other loudspeakers for interconnecting loudspeakers in a stacked relation, wherein loudspeakers in the stack of loudspeakers have sides to which left and right rigging frames can be mounted, said rigging side frame comprising a frame assembly mountable to the side of a loudspeaker and having two top corner regions and two bottom corner regions, said frame assembly being substantially formed by outer side plates and a center core structure sandwiched between said side plates, said core structure having at least one cutout forming a guide channel in at least one of the corner regions of said frame assembly and the seating surface in said guide channel, at least one pivot link and splay adjustment link associated with said frame assembly for linking the side frame of one loudspeaker to the side frame of a vertically adjacent loudspeaker, said pivot link and splay adjustment link each having a base end and a top extended end, the base end of each of said pivot link and splay adjustment link having at least one base end locking pin hole for pinning the base ends of said links to one of the corner regions of a vertically adjacent frame structure, and at least one of the top or bottom corner regions of said frame assembly including a guide channel formed to receive and cradle the base end of one of the pivot link or splay adjustment link of a vertically adjacent side frame, said guide channel being formed by the side plates and a cut-out in the center core structure of said frame assembly, and said guide channel having a seating surface provided by said core structure and locking pin holes that are spaced relative to said seating surface so that the locking pin hole in the base end of the pivot link or splay adjustment link self-aligns with the locking pin hole of said guide channel when the base end of said link is inserted in said guide channel against the seating surface thereof.

10. The rigging side frame of claim 9 wherein the seating surfaces of said guide channels and the base end of the pivot link and splay adjustment link received by said guide channels have complimentary rounded shapes.

11. The rigging side frame of claim 10 wherein said guide channel is located in one of the top corner regions of said frame structure.

12. The rigging side frame of claim 11 wherein the center core structure of said frame assembly is fabricated of a softer material than said side plates.

13. The rigging side frame of claim 12 wherein the side plates of said frame assembly are fabricated of steel and said center core structure is fabricated of aluminum.

14. The rigging side frame of claim 12 wherein the side plates of said frame assembly are fabricated of steel and said center core structure is fabricated of plastic.

15. A rigging side frame for a loudspeaker which can be interconnected with rigging side frames of other loudspeakers for interconnecting loudspeakers in a stacked relation, wherein loudspeakers in the stack of loudspeakers have sides to which left and right rigging frames can be mounted, said rigging side frame comprising a frame structure mountable to the side of a loudspeaker, said frame structure having two top corner regions and two bottom corner regions, a pivot link and splay adjustment link associated with said frame structure for linking a side frame of one loudspeaker to a side frame of a vertically adjacent loudspeaker, said pivot link and splay adjustment link each having a base end and a top extended end, the top extended end of said splay adjustment link having at least one row of splay adjustment locking pin holes for adjustably pinning said splay adjustment link to one of said corner regions of a vertically adjacent side frame, the base end of each of said pivot link and splay adjustment link having a base end locking pin hole for pinning the base ends of said links to one of the corner regions of a vertically adjacent side frame, the top or bottom corner regions of said frame structure including guide channels, one of which is formed to receive and cradle the base end of the pivot link of a vertically adjacent side frame and the other of which is formed to receive and cradle the base end of a splay adjustment link of the same vertically adjacent side frame, each of said guide channels having a seating surface and locking pin holes that are spaced relative to said seating surface so that, when inserted in their respective guide channels, the locking pin hole in the base end of the pivot link and splay adjustment link self-align with the locking pin hole of said guide channels when the base end of said links are seated against the seating surfaces of said guide channels, and the corner region of said frame structure, which is vertically opposite the guide channel for receiving the base end of a splay adjustment link of a vertically adjacent side frame, having a splay adjustment link stow channel shaped and sized to receive the splay adjustment link associated with said frame structure, the stow channel for said splay adjustment link including a row of splay adjustment pin holes corresponding to the splay adjustment pin holes in said splay adjustment link, wherein each of the splay adjustment pin holes in said splay adjustment link aligns at different splay angles with one of the splay adjustment pin holes provided by said splay adjustment link stow channel, such that a splay angle can be selected by selecting and pinning one of the splay adjustment pin holes in said splay adjustment link to its corresponding pin hole in the stow channel for the splay adjustment link.

16. The rigging side frame of claim 15 wherein the top extended end of said splay adjustment link includes two rows of splay adjustment locking pin holes, each of which aligns at a different splay angle with one of the splay adjustment pin holes provided by said splay adjustment link stow channel.

17. The rigging side frame of claim 16 wherein the splay adjustment pin holes in two rows of splay adjustment pin holes in the top extended end of said splay adjustment link are positioned to provide splay angle adjustments of between about zero degrees and five degrees.

18. The rigging side frame of claim 17 wherein the splay adjustment pin holes in two rows of splay adjustment pin holes in the top extended end of said splay adjustment link consist of nine pin holes which provide splay angle adjustments of between zero degrees and five degrees in 0.5 degree increments between zero degrees and three degrees and one degree increments between three degrees and five degrees.

19. The rigging side frame of claim 15 wherein the guide channels for the base ends of a splay adjustment link and pivot link of a vertically adjacent side frame are located in the top corner regions of said frame structure, and the stow channel for said splay adjustment link is located in the bottom corner region of said frame structure vertically opposite the guide channel for the base end of a splay adjustment link of a vertically adjacent side frame.

20. The rigging side frame of claim 15 wherein said splay adjustment link stow channel is shaped and sized to allow the splay adjustment link associated with said frame structure to be completely stowed therein when not in use, and wherein the locking pin hole in the base end of the splay adjustment link aligns with one of the splay adjustment locking pin holes when completely stowed for pinning said splay adjustment link in a stowed position.

21. The rigging side frame of claim 15 wherein the corner region of said frame structure, which is vertically opposite the guide channel for receiving the base end of a pivot link of a vertically adjacent side frame, has a pivot link stow channel shaped and sized to receive and stow the pivot link associated with said frame structure.

22. The rigging side frame of claim 21 wherein the stow channel for said pivot link includes a row of locking pin holes for alternatively pinning the top extended end of said pivot link associated with said frame structure in a deployed or stowed position.

23. The rigging side frame of claim 15 wherein said frame structure is an assembly comprised of outer side plates and a center core structure sandwiched between said side plates, said core structure having cutouts forming the guide channels and stow channels in said frame structure and the seating surfaces of said guide channels.

24. The rigging side frame of claim 23 wherein said center core structure is fabricated of a softer material than said side plates.

25. The rigging side frame of claim 24 wherein said side plates are fabricated of steel and said center core structure is fabricated of one of plastic or aluminum.

26. A rigging system for suspending loudspeakers in a vertically stacked array, the system comprising a plurality of left and right rigging side frames for attachment to left and right sides of the loudspeakers of the vertically stacked array, each rigging side frame comprising two top corner regions and two top bottom corner regions, pivot links for pivotally linking the bottom rear corner of the left and right rigging side frames mounted to one loudspeaker to the top rear corner of the left and right rigging side frames mounted to a vertically adjacent loudspeaker, splay adjustment links for adjusting the vertical splay angle between vertically adjacent loudspeakers, said splay adjustment links positioned to adjustably link the bottom front corner of the left and right rigging side frames mounted to one loudspeaker to the top front corner of the left and right rigging side frames mounted to a vertically adjacent loudspeaker, said pivot link and splay adjustment link each having a base end and a top extended end, the base end having at least one base end locking pin hole, the top extended end of said splay adjustment link having a plurality of splay adjustment locking pin holes for producing different splay angles, the vertical splay angles between adjacent loudspeakers within a vertically stacked array being set according to which splay adjustment pin hole of said splay adjustment link is selectively engaged to interconnect vertically adjacent rigging side frames, and pivot link and splay adjustment link guide channels being provided in the top corner regions of the left and right rigging side frames, said guide channels having associated link locking pin holes and a seating surface for receiving and cradling the base ends of the pivot and splay adjustment links of a vertically adjacent side frame so that the locking pin holes in the base of the pivot and splay adjustment links self align with the locking pin holes of said guide channels when the base ends of the links are inserted in said guide channels against the seating surfaces thereof.

27. The rigging system of claim 26 wherein the left and right rigging side frames are substantial mirror images of each other.

28. The rigging system of claim 26 wherein the splay adjustment link openings of said splay adjustment link provide for slay angle adjustments in increments of approximately 0.5 degrees or more.

29. The rigging system of claim 26 wherein said splay adjustment link provides for slay angle adjustments in increments from approximately zero to five degrees.

30. A method of interconnecting loudspeakers in a vertically stacked array, the method comprising providing a plurality of loudspeakers, mounting rigging side frames to two opposing sides of each loudspeaker, the rigging side frames each comprising a frame structure having pin openings and at least one pivot link and splay adjustment link each having a base end and top extended end, the base ends of each link having at least one locking pin hole and being attached to said frame structure by, respectively, a first and second locking pin, the top extended end of the splay adjustment link having a plurality of splay adjustment pin holes, guide channels in the top corner regions on said frame structure for receiving and cradling the base ends of a pivot link and splay adjustment link from a vertically adjacent side frame, and for self aligning the locking pin holes in the base ends of said pivot and splay adjustment links with locking pin holes in said frame structure, dropping said pivot links from a stowed position on each frame structure into said corresponding guide channel such that the base end of the pivot link is cradled by the guide channel to produce alignment of locking pin holes in the base of the pivot link and the frame structure, the dropping of the pivot links being initiated by removing a first locking pin holding the pivot links in a stowed position, pinning said pivot links to a vertically adjacent side frame by inserting the first locking pin into aligned locking pin holes of the pivot link and frame structure, dropping a splay adjustment link from a stowed position on each frame structure into a guide channel by removing a second locking pin, selecting a splay angle by matching a selected one of the splay adjustment pin holes with a pin hole in the frame structure and inserting the second locking pin therethrough, pinning the splay adjustment link to a vertically adjacent side frame by dropping the base end of the splay adjustment link into a guide channel of the vertically adjacent side frame such that the base end of the splay adjustment link is cradled by the guide channel to produce alignment of locking pin holes in the base of the splay adjustment link and the frame structure, and inserting a third locking pin therethrough.

* * * * *

UNITED STATES PATENT AND TRADEMARK OFFICE

CERTIFICATE OF CORRECTION

PATENT NO. : 7,634,100 B2
APPLICATION NO. : 11/035676
DATED : December 15, 2009
INVENTOR(S) : John Monitto, John McGhee and Dean Marshall It is certified that error appears in the above-identified patent and that said Letters Patent is hereby corrected as shown below:

On the title page item (57), in the abstract, line 15, --of-- should be inserted between "insertion" and "locking."
In column 3, line 18, "position" should read --positions--.
In column 6, line 52, "link" should read --links--.
In column 6, line 53, "link" should read --links--.
In column 7, line 50, "link" should read --links--.
In column 7, line 51, "link" should read --links--.
In column 7, line 56, "link" should read --links--.
In column 7, line 57, "link" should read --links--.
In column 8, line 51, "self-align" should read --self-aligns--.
In column 9, line 60, "one of" should read --either--.
In column 10, line 42, "slay" should read --splay--.
In column 10, line 45, "slay" should read --splay--.

Signed and Sealed this
Eighth Day of March, 2011

David J. Kappos

David J. Kappos
*Director of the United States Patent and Trademark Office*